US012685381B2

(12) United States Patent
Coeur et al.

(10) Patent No.: US 12,685,381 B2
(45) Date of Patent: Jul. 21, 2026

(54) REFILLABLE CUP FOR A POT FOR DISPENSING A COSMETIC PRODUCT

(71) Applicant: ALBEA SERVICES, Gennevilliers (FR)

(72) Inventors: Inès Coeur, Gennevilliers (FR); Franck Seguin, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 24 days.

(21) Appl. No.: 18/565,290

(22) PCT Filed: Jul. 7, 2022

(86) PCT No.: PCT/EP2022/069009
§ 371 (c)(1),
(2) Date: Nov. 29, 2023

(87) PCT Pub. No.: WO2023/281028
PCT Pub. Date: Jan. 12, 2023

(65) Prior Publication Data

US 2024/0245195 A1 Jul. 25, 2024

(30) Foreign Application Priority Data

Jul. 9, 2021 (FR) ..... 2107510

(51) Int. Cl.
*A45D 40/00* (2006.01)
*B65D 77/04* (2006.01)

(52) U.S. Cl.
CPC ..... *A45D 40/0068* (2013.01); *B65D 77/0486* (2013.01)

(58) Field of Classification Search
CPC ..... A45D 40/0068; A45D 40/06; B65D 77/0486; B65D 21/02; B65D 23/00
(Continued)

(56) References Cited

U.S. PATENT DOCUMENTS

2010/0176131 A1* 7/2010 Lopez Leon ..... B65D 77/0486 220/315
2022/0211161 A1 7/2022 Del Din et al.

FOREIGN PATENT DOCUMENTS

KR 102164827 B1 * 10/2020 ..... A45D 40/00
KR 102216642 B1 * 2/2021 ..... A45D 40/26
(Continued)

OTHER PUBLICATIONS

English translation of KR 1012164827 (Year: 2020).*
(Continued)

*Primary Examiner* — Nathan J Jenness
*Assistant Examiner* — Eric C Baldrighi
(74) *Attorney, Agent, or Firm* — Morgan, Lewis & Bockius LLP

(57) ABSTRACT

A cup for a pot for dispensing a cosmetic product, which is able to contain the cosmetic product and has a central axis X is described. The cup can include a peripheral wall surmounted by a flat upper rim from which there extends an annular collar oriented parallel to the peripheral wall and at a distance from the peripheral wall so as to define therebetween a gap for receiving a neck of a base of the pot. The collar comprises a lower rim of continuous profile extending around the entire perimeter of the collar and having at least two diametrically opposite ramps; and at least two diametrically opposite gripping lugs defined in part by the ramps.

24 Claims, 3 Drawing Sheets

(58) Field of Classification Search
USPC ..... 215/6; 220/23.89, 23.87, 23.86
See application file for complete search history.

(56) References Cited

FOREIGN PATENT DOCUMENTS

| | | | | |
|---|---|---|---|---|
| WO | WO-2007022608 A1 * | 3/2007 | ..... | A45D 40/0068 |
| WO | 2021058518 A1 | 4/2021 | | |

OTHER PUBLICATIONS

English translation of KR 102216642 (Year: 2021).*
PCT/EP2022/069009, "International Search Report and Written Opinion", Oct. 25, 2022, 12 pages.
PCT/EP2022/069009, English Translation of "International Search Report", Oct. 25, 2022, 2 pages.

* cited by examiner

[Fig.1]
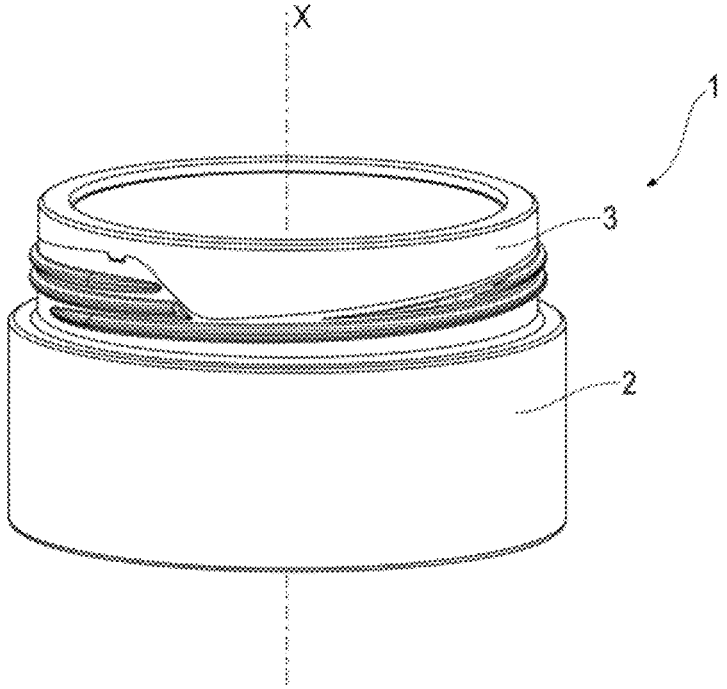

[Fig.2]
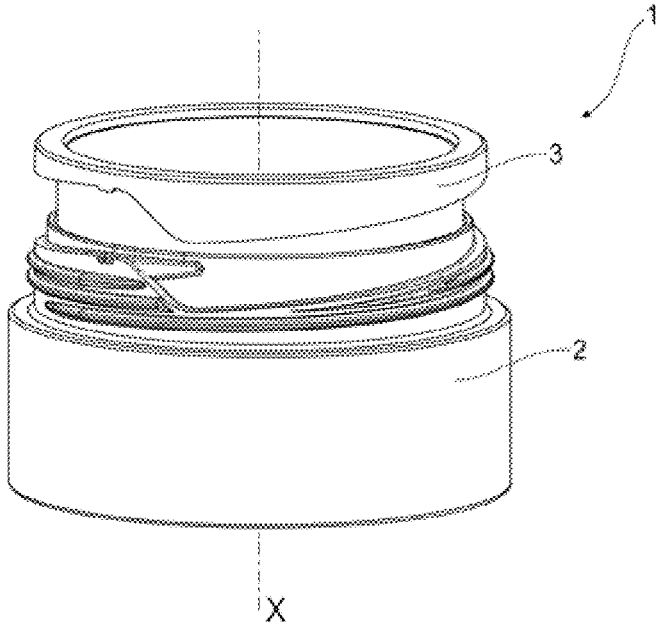
[Fig.3]
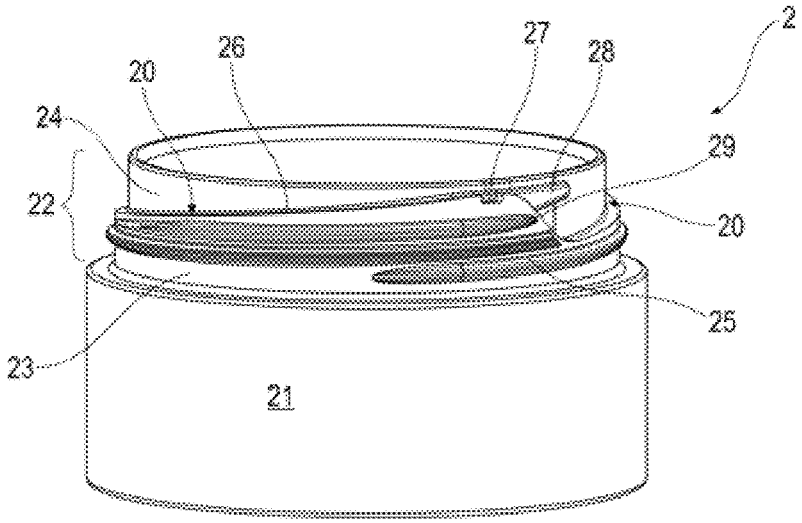

[Fig.4]
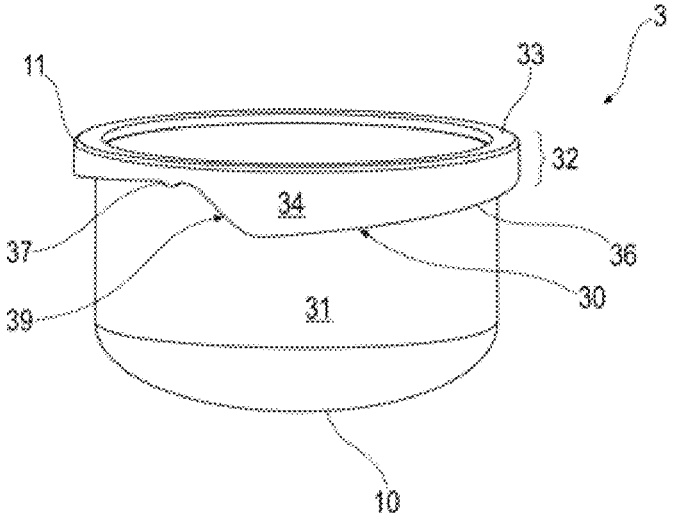
[Fig.5]
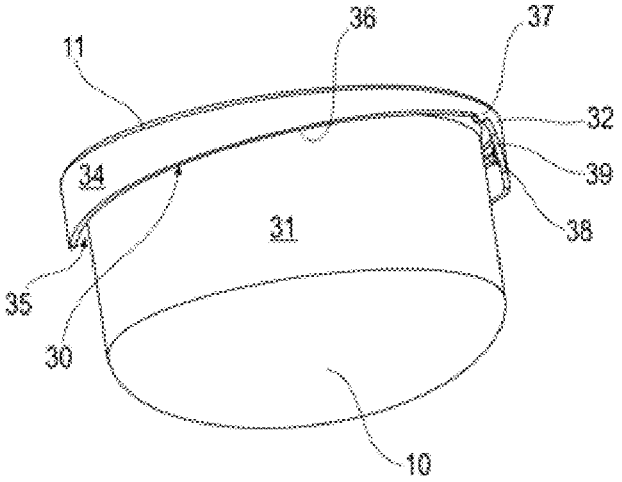

REFILLABLE CUP FOR A POT FOR DISPENSING A COSMETIC PRODUCT

CROSS-REFERENCE TO RELATED APPLICATIONS

This application is the National Stage of International Application No. PCT/EP2022/069009, filed Jul. 7, 2022, which claims priority to French Application No. 2107510, filed Jul. 9, 2021, and the contents of which are incorporated by reference.

TECHNICAL SCOPE OF THE INVENTION

The invention concerns a cup for refilling a pot with a cosmetic product, such as skincare cream or make-up powder.

In this case, the pot comprises a base that receives the cup containing the cosmetic product. When the cup is empty, simply remove it and place a new one in the base.

TECHNICAL BACKGROUND

The pots for dispensing a cosmetic product are known, comprising a base that receives a cup containing a cosmetic product. These pots are closed with lids. These pots are refillable. When the cup is empty, it is replaced by another cup filled with a cosmetic product. This means that you can keep the pot and its lid, which are often made of noble materials such as glass, concrete or wood, and only throw away the cup, which is usually made of plastic.

When the cup is in place in the base, it can sometimes be difficult to remove it for replacement, as the cup has no accessible surface to grip it. In fact, it is completely embedded in the base.

To overcome this disadvantage, it is known to provide a collar at the upper portion of the cup which rests on the upper rim of the base, allowing the user to grasp the cup with his fingernails through the collar. However, this collar is thin and sometimes stuck to the upper rim of the base due to dirt, and the user has to try several times to remove the cup from the base.

On the other hand, when the cup is in place in the base, it tends to rotate within the base when the user retrieves product, which is undesirable.

SUMMARY OF THE INVENTION

The aim of the present invention is to overcome the various disadvantages set out above, by means of a cup which can be easily gripped by the user to make it easier to remove it from the base and position it in the base. The cup must also be easy to move into its final position in the base.

This purpose is achieved by means of a cup for a pot for dispensing a cosmetic product, capable of containing the cosmetic product, and having a central axis X, said cup having a peripheral wall surmounted by a flat upper rim from which extends an annular collar oriented parallel to the peripheral wall and at a distance from the peripheral wall so as to define between them a gap for receiving a neck of a base of a pot, said collar having:

- a lower rim with a continuous profile extending around the entire circumference of the collar and comprising at least two diametrically opposed ramps;
- at least two diametrically opposed gripping lugs defined in part by the ramps.

The main idea behind this invention is to provide a cup with a specially shaped collar that can perform several functions, namely gripping the cup using the gripping lugs, and placing the cup in its final position in the base using the ramps on the lower rim.

This collar is aesthetically pleasing, with a pure line thanks to the lower rim with continuous profile. There are no discontinuities, no protruding shapes, but instead a soft, harmonious line.

According to the various embodiments of the invention, which may be taken together or separately:

- each ramp of the lower rim ends in a return, and each ramp starts after a return, each return marking a junction between two ramps so as to form the continuous profile.
- each gripping lug extends over an angular sector corresponding to at least one eighth of the circumference of the collar.
- the cup comprises means for axial blocking relative to the base, arranged on the gripping lugs. They are located on the inner face of the gripping lugs.
- the cup comprises means for rotation blocking relative to the base, arranged at a distance from the gripping lugs. They are located at the very beginning of the ramp after a return.

In this way, the axial blocking means and the rotation blocking means are dissociated and independent, as they are located at different points. This provides a better distribution of tensions, and therefore greater robustness.

The invention also relates to a pot for dispensing a cosmetic product having a central axis X and comprising:

- a base opened in the upper portion and having a neck;
- a cup as described above, housed inside the base;
- a lid for tightly closing the pot, cooperating with the neck of the base.

The neck of the base is housed partly in the gap of the cup defined between the peripheral wall and the collar.

According to the various embodiments of the invention, which may be taken together or separately:

- the neck of the base has a refined upper annular area receiving the collar and a lower annular area for attaching to the lid, said lower annular area being delimited from the upper annular area by an external shoulder of continuous profile matching said profile of the lower rim of the collar, the lower rim coming to rest on the external shoulder after the cup has been positioned in the base.
- the collar externally covers said upper refined annular area.
- the collar has a thickness that compensates for the refining of the upper annular area so that the collar is flush with the lower annular area.
- the pot comprises means for axially blocking the cup in the base.
- said means for axially blocking the cup consist of a rib provided on the upper annular area of the base, and capable of being positioned axially downstream of another rib provided for this purpose in the internal wall of the collar, the ribs being oriented radially so as to block any axial displacement of the cup with respect to the base.
- the pot comprises means for blocking the cup against rotation in the base.
- said means for blocking the cup against rotation consist of a notch provided on the external shoulder of the base, and capable of receiving a protuberance provided for this purpose on the lower rim of the collar of the cup, their snap-fitting taking place when the cup has been mounted in the base.

each ramp on the lower rim cooperates with a ramp on the external shoulder, so that the rims slide over each other via these ramps when the cup is mounted into the base.

each ramp of the lower rim terminates in a return that comes in abutment against a return of the external shoulder, indicating that the cup has been fully mounted in the base.

each ramp of the external shoulder terminates in a return, and each ramp starts after a return, each return marking a junction between two ramps so as to form the continuous profile of the external shoulder.

the base and the cup are made of plastic.

BRIEF DESCRIPTION OF THE FIGURES

Further characteristics and advantages of the invention will become apparent from the following detailed description, for the understanding of which reference is made to the attached drawings in which:

FIG. 1 is a perspective view of a pot according to the invention;

FIG. 2 is an exploded perspective view of the pot;

FIG. 3 shows the base of the pot;

FIG. 4 shows the cup of the pot;

FIG. 5 is another view of the cup of the pot.

DETAILED DESCRIPTION OF THE INVENTION

By convention, the "axial" direction corresponds to the main extension of the receptacle, illustrated by the axis X in FIG. 1, and the "radial" direction is orthogonal to the axial direction.

In the following detailed description of the figures, the terms "upper" and "lower" or "high" and "low" will be used without limitation in reference to the axial direction.

Similarly, the terms "outer or external" and "inner or internal" are used with reference to the radial direction, an outer element being radially further from the axis X than an inner element.

The pot 1 for dispensing a cosmetic product shown in FIGS. 1 and 2 extends along a main axis X and consists mainly of a base 2 into which a cup 3 is inserted. A lid (not shown) comes to seal the base 2 by screwing or any other conventional attachment method.

The cup 3 packages the cosmetic product. The cup 3 is a product refill and is removable from the base 2 so that it can be replaced by a new cup 3 filled with product when the previous one is empty.

By cosmetic product, we mean, for example, a make-up powder, or a semi-fluid product such as a cream or foundation type.

The base 2 and the cup 3 have forms of revolution about the main axis X. They are hollow and open at the upper portion.

The cup 3, which can contain the product, is housed inside the base 2.

The base 2 comprises a bottom.

However, an embodiment in which the base 2 has no bottom is within the scope of the present invention. In this case, the bottom 10 of the cup 3 will act as the bottom for the pot 1.

The cup 3, as shown in FIGS. 4 and 5, has a peripheral wall 31 and is open at the upper portion.

The peripheral wall 31 is surmounted by a flat external shoulder 33 oriented perpendicularly to the axis X. An annular collar 32 oriented parallel to the axis X extends from this external shoulder 33. This collar 32 extends towards the bottom 10 of the cup 3.

This collar 32 is continuous all around the upper portion of the cup 3. It is located at a distance from the peripheral wall 31 of the cup 3, so as to create a gap 35 between them, the function of which will be explained later in the description.

This collar 32 has a lower rim 36 with a continuous profile extending around the entire circumference of the collar 32.

This lower rim 36 comprises ramps 30 for positioning the cup 3 in the base 2.

Preferably the lower rim 36 comprises two diametrically opposed ramps 30.

In another example, the collar 32 could comprise more than two ramps 30.

Switching from one ramp 30 to another is done via a return 39 positioned at the end of one ramp 30 and at the start of the adjacent ramp 30. In this way, each ramp 30 starts after a return 39, and each ramp 30 ends with a return 39. Each return 39 marks a junction between two ramps 30 so as to form the continuous profile of the external shoulder 26.

The inclination of the ramps 30 is directed towards the bottom 10 of the cup 3, while the inclination of the return 39 is directed towards the external shoulder 33 of the cup 3. The ramp 30 and the return 39 therefore have opposite slopes.

The collar 32 has gripping lugs 34, i.e. relatively large areas where the user can place his fingers to grip the cup 3.

Each area must be large enough to accommodate at least one finger. Preferably, the collar 32 comprises two diametrically opposed lugs 34. In this way, the user can hold the cup 3 with two fingers of the same hand.

In another example, there could be three or four lugs 34. The lugs 34 are delimited mainly on one side by the end of a ramp 30 and its return 34, and on the other side by the edge 11 located between the external shoulder 33 and the collar 32.

The base 2, as shown in FIG. 3, comprises a reservoir 21 surmounted by a neck 22 having attachment means which can cooperate with a lid. In this case, it is an external thread 25 provided around the neck 22, and which is able to cooperate with an internal thread provided in the lid. More specifically, the neck 22 of the base 2 has a lower annular area 23 for attaching to the lid, as this lower annular area 23 comprises said external thread 25.

The neck 22 of the base 2 also has an upper annular area 24 designed to receive the collar 32 of the cup 3 when the latter is placed in the base 2.

This upper annular area 24 is refined, which means that its thickness is thinner than the thickness of the lower annular area 23. This results in the creation of an external shoulder 26.

This external shoulder 26 has a continuous profile that matches the profile of the lower rim 36 of the collar 32. The shape of the lower rim 36 and the shoulder 26 therefore match, so that the lower rim 36 can rest on the shoulder 26 after the cup 3 has been positioned in the base 2.

The external shoulder 26 has a plurality of ramps 20 and returns 29, like the lower rim 36. Thus, each ramp 20 ends with a return 29 and starts after a return 29, each return 29 marking a junction between two ramps 20 so as to form the continuous profile of the external shoulder 26. When the user comes to mount the cup 3 in the base 2, he pushes the peripheral wall 31 of the cup 3 into the cavity of the base 2, then the ramp 39 of the lower rim 36 comes into contact with the ramp 29 of the external shoulder 26. To complete the insertion of the cup 3, the user simply turns the cup 3 relative to the base 2 so that the lower rim 36 slides over the shoulder 26 along the ramps 30, 20, until the returns 39 of the lower rim 36 of the cup 3 comes in abutment against the returns 29 of the external shoulder 26 of the base 2. These abutments indicate the end of the mounting of the cup 3 in the base 2. The cup 3 is then placed into the base 2. This insertion and the positioning is made very easy by the clean, continuous lines of the collar 32 of the cup 3 and the neck 22 of the base 2.

It is understood from this description that the cup 3 is inserted into the base 2 using a single hand, by an axial movement of the cup 3 relative to the base 2, followed by positioning the cup 3 in the base 2 by a rotational movement of the cup 3 relative to the base 2.

When the cup 3 is positioned in the base 2, the end of the refined upper annular area 24 is housed in the gap 35 of the cup 3 provided between the collar 32 and the peripheral wall 31 of the cup 3. And the collar 32 externally covers the refined upper annular area 24. Preferably, the thickness of the collar 32 compensates the refining of the upper annular area 24 so that the collar 32 is flush with the lower annular area 23. The collar 32 is nested into the upper annular area 24 of the neck 22.

Advantageously, the pot 1 comprises means for axially blocking the cup 3 in base 2.

These means for axially blocking the cup 3 consist, for example, of a rib 28 provided on the upper annular area 24 of the base 2, as illustrated in FIG. 3, and able to be positioned axially downstream, i.e. above, another rib 38 provided for this purpose in the internal wall of the collar 32 as shown in FIG. 5, the ribs 28, 38 being oriented radially so as to block any axial movement of the cup 3 with respect to the base 2. In other words, the base 2 carries a high rib 28, and the cup 3 carries a low rib 38, so that the high rib 28 retains the low rib 38 when the user accidentally lifts the cup 3 along the axis X. The high rib 28 acts as an abutment against which the low rib 38 comes to bear when the cup 3 is accidentally moved axially away from the base 2.

The upper rib 28 acts as a hard point to pass over when the cup 3 is actually removed.

In the example shown, the rib 28 of the base 2 extends from a return 29 of the external shoulder 26 on the upper refined annular area, and the rib 38 of the cup 3 extends from a return 39 of the lower rim 36, on the reverse side of a gripping lug 34. In this way, the rib 28 is nested into the gap 35 above the rib 38 only when the cup 3 has been mounted in the base 2.

In another example, the rib 38 could be replaced by a groove into which the rib 28 fits.

Advantageously, the pot 1 comprises means for blocking the cup 3 against rotation in the base 2.

These means for blocking the cup 3 against rotation consist, for example, of a notch 27 provided on the external shoulder 26 of the base 2, as shown in FIG. 3, and suitable for receiving a protuberance 37 provided for this purpose on the lower rim 36 of the collar 32 of the cup 3, as shown in FIG. 4. The notch 27 and the protuberance 37 are each provided at the very beginning of the ramp 20, 30, just downstream of a return 29, 39, so that they snap-fit into place only at the end of the mounting of the cup 3 in the base 2. After snap-fitting, the cup 3 is blocked against rotation relative to the base 2, in both directions of rotation, as the protuberance 37 comes into abutment against the lateral walls defining the notch 27. This prevents the cup 3 from rotating in the base 2.

In another example, the notch 27 could be made on the lower rim 36 of the collar 32 of the cup 3, while the protuberance would be provided on the external shoulder 26 of the base 2.

Preferably, the base 2 is made of glass, terracotta, concrete, wood or metal for an aesthetic effect, and the cup 3 is made of aluminium or a plastic material.

The plastic material may be selected from polypropylene (PP), recycled polypropylene (R-PP), polyethylene terephthalate (PET), recycled polyethylene terephthalate (R-PET), thermoplastic elastomer (TPE), polyethylene (PE), such as the low density polyethylene (LDPE) and/or the high density polyethylene (HDPE), composite material, post-consumer recycled material (PCR and/or similar material). Preferably, it is polypropylene and/or polyethylene terephthalate, whether recycled or not. Advantageously, all the parts, i.e. the base 2, the cup 3 and possibly the lid, are made of a plastic chosen from polypropylene and/or polyethylene terephthalate.

In addition, the use of plastics, in particular similar plastics for the entire pot 1, allow to facilitate the recycling. In particular, the polypropylene and the polyethylene terephthalate are two plastic materials whose recycling cycle is well known.

The pot 1 can be made in 3D printing.

In particular, the base 2, the cup 3 and possibly the lid can be produced using 3D printing. Such a printing method allows in particular to freely produce these pieces with patterns and shapes that contribute to the aesthetic appearance of the pot 1.

The configurations shown in the cited figures are only possible examples, in no way limiting, of the invention which, on the contrary, encompasses the variations of shapes and designs within the reach of the person skilled in the art.

The invention claimed is:

1. A pot for dispensing a cosmetic product having a central axis X and comprising:

a base opened in an upper portion and comprising a neck;

a lid configured to tightly close the pot by cooperation with the neck of the base; and a cup housed inside the base and capable of containing the cosmetic product, the cup comprising a peripheral wall surmounted by a flat upper rim from which extends an annular collar oriented parallel to the peripheral wall and at a distance from the peripheral wall so as to define therebetween a gap for receiving the neck of the base, the collar comprising:

a lower rim with a continuous profile extending around an entire circumference of the collar and comprising at least two diametrically opposed ramps, and at least two diametrically opposed gripping lugs defined in part by the ramps, wherein the pot further comprises axial-blocking features provided on the cup and on the base and configured to block axially the cup in the base, the axial-blocking feature of the cup being arranged on the gripping lugs, wherein the pot further comprises rotation-blocking features provided on the cup and on the base and configured to block rotation of the cup in the base, the rotation-blocking feature of the cup being arranged at a distance from the gripping lugs, the rotation-blocking features consisting of complementary interlocking elements respectively provided on the collar of the cup and on an exterior peripheral surface of the neck of the base, wherein the ramps, the axial-blocking features, and the rotation-blocking features are configured such that a single helical rotational movement of the cup relative to the base simultaneously engages both the axial-blocking features and the rotation-blocking features to secure the cup in the base.

2. The cup according to claim 1, wherein each ramp of the lower rim ends in a return, and each ramp starts after a return, each return marking a junction between two ramps so as to form the continuous profile.

3. The cup according to claim 1, wherein each gripping lug extends over an angular sector corresponding to at least one eighth of the circumference of the collar.

4. The pot according to claim 1, wherein the neck of the base has a refined upper annular area receiving the collar and a lower annular area for attaching to the lid, said lower annular area being delimited from the upper annular area by an external shoulder of continuous profile matching a profile of the lower rim of the collar, the lower rim coming to rest on the external shoulder after the cup has been positioned in the base.

5. The pot according to claim 4, wherein the collar externally covers said upper annular area.

6. The pot according to claim 5, wherein the external surface of the collar is flush with the external surface the lower annular area.

7. The pot according to claim 4, wherein each ramp of the lower rim cooperates with a ramp of the external shoulder, so that the lower rim slides over the external shoulder via these ramps when the cup is mounted in the base.

8. The pot according to claim 7, wherein each ramp of the external shoulder terminates in a return, and each ramp starts after a return, each return marking a junction between two ramps so as to form the continuous profile of the external shoulder.

9. The pot according to claim 4, wherein the complementary interlocking element of the base is disposed in proximity to an external shoulder of the neck.

10. The pot according to claim 1, wherein said axial-blocking features consist of a rib provided on an upper annular area of the base, and capable of being positioned axially downstream of another rib provided for this purpose in an internal wall of the collar, the ribs being oriented radially so as to block any axial displacement of the cup with respect to the base.

11. The pot according to claim 1, wherein said rotation-blocking features consist of a notch provided on an external shoulder of the base, the notch being outward facing relative the ramps, and capable of receiving a protuberance provided for this purpose on the lower rim of the collar of the cup, their snap-fitting taking place when the cup has been mounted in the base.

12. The pot according to claim 11, wherein each ramp of the lower rim terminates in a return coming in abutment against a return of the external shoulder, indicating an end of mounting of the cup in the base.

13. The pot according to claim 1, wherein the base and the cup are made of plastic.

14. A pot for dispensing a cosmetic product suitable for receiving a cup containing a cosmetic product, the pot having a central axis X and comprising a base comprising a reservoir surmounted by a neck, the reservoir defining a cavity suitable for receiving the cup and being open at the top and suitable for being closed by a lid, the neck of the base having a lower annular zone for attachment to the lid and an upper annular zone for attachment to the cup, wherein the neck comprises axial-blocking features for axially locking the cup in the base and rotation-blocking features for rotationally locking the cup in the base, said axial-blocking features being independent of said rotation-blocking features, and wherein the upper annular zone comprises ramps configured to cooperate with corresponding ramps on the cup such that a single helical rotational movement of the cup relative to the base simultaneously engages both the axial-blocking features and the rotation-blocking features to secure the cup in the base, wherein the rotation-blocking features consist of complementary interlocking elements respectively provided on the collar of the cup and on an exterior peripheral surface of the neck of the base.

15. The pot according to claim 14, wherein said axial-blocking features consist of a rib provided on the upper annular zone of the base, said rib being radially oriented.

16. The pot according to claim 15, wherein the upper annular zone of the neck is refined, said lower annular zone being delimited from the upper annular zone by an external shoulder of continuous profile on which a collar of the cup is able to come to rest after the cup has been positioned in the base.

17. The pot according to claim 16, wherein said complementary interlocking element of the base for locking rotation of the cup comprises partly of a notch provided on the external shoulder of the base, the notch being outward facing relative the ramps.

18. The pot according to claim 17, wherein the notch is capable of receiving a protuberance provided for this purpose on the lower rim of the collar of the cup and corresponding to the complementary interlocking element of the cup.

19. The pot according to claim 16, wherein the external shoulder has a plurality of ramps and returns, each ramp terminates in a return, and each ramp starts after a return, each return marking a junction between two ramps so as to form the continuous profile of the external shoulder.

20. The pot according to claim 19, wherein a notch is provided at the start of a ramp just downstream of a return.

21. The pot according to claim 20, wherein the rib extends from a return.

22. The pot according to claim 16, wherein the complementary interlocking element of the base is disposed in proximity to the external shoulder of the neck.

23. The pot according to claim 14, wherein the pot is made of plastic.

24. The pot according to claim 14, wherein the base is made of glass.

* * * * *